US007323244B2

(12) United States Patent
Cho et al.

(10) Patent No.: US 7,323,244 B2
(45) Date of Patent: Jan. 29, 2008

(54) LOW AND WEAKLY-INTERLACED POLYESTER MULTIFILAMENT YARN AND METHOD OF PRODUCING THE SAME

(75) Inventors: Dae-hwan Cho, Seoul (KR); Dong-seok Shim, Seoul (KR)

(73) Assignee: Hyosung Corporation, Seoul (KR)

( * ) Notice: Subject to any disclaimer, the term of this patent is extended or adjusted under 35 U.S.C. 154(b) by 226 days.

(21) Appl. No.: 10/833,846

(22) Filed: Apr. 27, 2004

(65) Prior Publication Data

US 2005/0227562 A1 Oct. 13, 2005

(30) Foreign Application Priority Data

Apr. 12, 2004 (KR) ..... 10-2004-0024996

(51) Int. Cl.

| | |
|---|---|
| ***D02G 3/00*** | (2006.01) |
| ***D02G 1/00*** | (2006.01) |
| ***D02G 1/16*** | (2006.01) |
| ***D02J 1/08*** | (2006.01) |

(52) U.S. Cl. ..... 428/369; 428/364; 428/397; 428/401; 28/247; 28/271

(58) Field of Classification Search ..... 428/364, 428/369, 397, 400, 401; 57/206, 208, 243, 57/246, 248

See application file for complete search history.

(56) References Cited

U.S. PATENT DOCUMENTS 3,701,248 A 10/1972 Gray
5,518,814 A 5/1996 Boenigk

FOREIGN PATENT DOCUMENTS

KR 2002-0048368 6/2002

*Primary Examiner*—Jenna Befumo
(74) *Attorney, Agent, or Firm*—Michael J. Striker

(57) ABSTRACT

Disclosed is a low and weakly-interlaced industrial polyester multifilament yarn, which has excellent flatness and flat uniformity, and in which the number of monofilament layers is properly controlled according to a fineness of the low and weakly-interlaced polyester multifilament yarn and monofilaments are interlaced, thereby reducing a surface brightness gradient of a coated fabrics, produced using the low and weakly-interlaced polyester multifilament yarn, when light is irradiated to the coated fabrics. Additionally, the present invention provides a method of producing the low and weakly-interlaced polyester multifilament yarn, in which air pressure of an air interlacing device, a yarn path, tension of the yarn, an helix angle of the yarn wound around a cheese, intervals between first guides, located before and after the air interlacing device, and second guides, located in the air interlacing device, and a position of a wave plate are properly controlled.

5 Claims, 7 Drawing Sheets

LOW AND WEAKLY-INTERLACED POLYESTER MULTIFILAMENT YARN AND METHOD OF PRODUCING THE SAME

BACKGROUND OF THE INVENTION

1. Field of the Invention

The present invention pertains to a low and weakly-interlaced industrial polyester multifliament yarn, which has excellent flatness and flat uniformity, and in which the number of monofilament layers is properly controlled according to a denier of the low and weakly-interlaced polyester multifilament yam and monofilaments are weakly interlaced, thereby reducing a surface brightness gradient of a coated fabrics, produced using the low and weakly-interlaced polyester multifilament yarn, when light is irradiated to the coated fabrics, and a method of producing the same. More particularly, the present invention relates to a low and weakly-interlaced polyester multifilament yarn, which is usefully applied to weave woven fabrics or to knit an industrial knitted fabrics with a relatively low density without a twisting or sizing process, and which is relatively thin and has excellent flatness, thereby being usefully applied to coated thin woven fabrics or knitted goods with a smooth surface, and a method for producing the same. In this regard, monofilaments constituting the coated fabrics occur when light is irradiated to the coated fabrics. On the other hand, when the average tear strength of the interlaced portions is less than 3 gf, the yarn is scarcely interlaced, and thus, the condensation of the yarn is reduced, thereby significantly reducing workability of an after-treatment process, such as a weaving process.

2. Description of the Prior Art

As well known to those skilled in the art, an air interlacing process includes blowing air to a multifilament yarn at a predetermined angle under a predetermined air pressure to collide air to the multifilament yarn, thereby bringing about a turbulence around the multifilament yarn. In this respect, the turbulence around the multifilament yarn causes the interlaced portions and the irregular entanglement of monofilaments constituting the multifilament yarn. The air interlacing process enables the multifilament yarn to be condensed without a conventional twisting or sizing process. Accordingly, the air interlacing process contributes to easily conducting weaving and knitting processes, and to improving the physical properties of end products, produced using the interlaced multifilament yarn. In this respect, the air interlacing process is advantageous in that because the conventional twisting or sizing process may be omitted the production costs are reduced and the workability is improved.

One example of the conventional air interlacing process is disclosed in U.S. Pat. Nos. 3,701,248 and 5,518,814, in which an interlaced multifilament yarn is strongly condensed so as to enable a section thereof to be conglomerated, thereby improving the weaving workability without a sizing and twisting process.

The conventional interlaced yarn, produced according to the conventional air interlacing process, has relatively many interlaced portions, that is, 5 or more per one meter as shown in FIG. 8. Additionally, the conventional interlaced yarn has different lengths of the interlaced portions (LK) and different thicknesses at different openings thereof, and thus, a surface of a coated fabrics, containing the conventional interlaced yarn, is non-uniform.

Furthermore, the conventional interlaced yarn, produced according to the conventional air interlacing process, is problematic in that lengths between the interlaced portions (LBK) are different from each other, its thickness uniformity is poor because thickness differences between the interlaced portions and openings are relatively large, the capillary or fluff easily occurs because relatively high air pressure is applied to the conventional interlaced yarn to reduce qualities of end products, and the production costs are increased.

As well, Korean Pat. Laid-Open Publication No. 2002-48368 recites a process of producing a low and weakly-interlaced yarn with a few interlaced portions by controlling air pressure of an air interlacing device, tension of the interlaced yarn, and a winding helix angle on a yarn package. However, this process is disadvantageous in that many strongly interlaced portions are formed in the interlaced yarn to bring about a brightness gradient on a surface of a coated fabrics acting as end products, produced using the interlaced yarn, when the coated fabrics is irradiated by light or light is transmitted through the surface of the coated fabrics. Hence, the interlaced yarn is not suitable as the coated fabrics for a banner advertisement.

SUMMARY OF THE INVENTION

Therefore, the present invention has been made keeping in mind the above disadvantages occurring in the prior arts, and an object of the present invention is to provide a low and weakly-interlaced polyester multifilament yarn suitable for a coated fabrics, of which the tear strength and tear strength peak number are properly controlled to enable the polyester multifilament yarn to be low and weakly-interlaced.

Another object of the present invention is to provide a low and weakly-interlaced polyester multifilament yarn, and a method of producing the same, in which lengths between first guides, located before and after an air interlacing device, and second guides, located in the air interlacing device are set to 50 cm or less, a wave plate is positioned outside of a winder to increase tension of the polyester multifilament yarn, and the number of mono filament layers is controlled to be few so as to smoothly flatten the polyester multifilament yarn. Thereby, the low and weakly-interlaced polyester multifilament yarn contributes to improving an appearance of a coated fabrics, produced using the low and weakly-interlaced polyester multifilament yarn, for advertisement and to reducing a surface brightness gradient of the same.

BRIEF DESCRIPTION OF THE DRAWINGS

The above and other objects, features and other advantages of the present invention will be more clearly understood from the following detailed description taken in conjunction with the accompanying drawing, in which.

DETAILED DESCRIPTION OF THE INVENTION

According to the present invention, a low and weakly-interlaced polyester multifilament yarn (hereinafter, referred to as "low and weakly-interlaced yarn") is characterized in that an average number of interlaced portions is 0.4 to 4.0 number/m, a length deviation of lengths of openings (LO) (CV %) (hereinafter, referred to as "deviation of interlaced portions") is 75% or less, an average thickness is 45 to 81 μm, an average tear strength of interlaced portions is 3 to 15 gf, and the number of peaks, at which the average tear strength of interlaced portions is 3 gf or more, is 8 peaks or less/5000 mm.

Accordingly, the low and weakly-interlaced yarn according to the present invention is advantageous in that the lengths of openings (LO) are 5000 mm or less, and the number of the interlaced portions is less than 4 number/m leading to the reduction of capillary and fluff, and thus, qualities of end products using the low and weakly-interlaced yarn of the present invention are not reduced. Further, the low and weakly-interlaced yarn of the present invention can be applied to a coated thin fabrics with a uniform thickness because the yarn is thin and has the deviation of the interlaced portions of 75% or less. When the said deviation of the low and weakly-interlaced yarn is more than 75%, the uniformity of the thickness of the yarn is very poor, leading to the poor flatness and flat uniformity of the low and weakly-interlaced yarn, thereby the low and weakly-interlaced yarn is not suitable for the coated fabrics.

Furthermore, it is preferable that the average tear strength of the interlaced portions is 3 to 15 gf. In this respect, the tear strength means a force capable of longitudinally tearing the center of the interlaced yarn into two pieces. Higher tear strength is needed to tear the strongly interlaced yarn. When the average tear strength of the interlaced portions is more than 15 gf, the tenacity of the interlaced portions and the conglomeration of the yarn are increased, and thus, the surface brightness gradient of the coated fabrics occurs when light is irradiated to the coated fabrics. On the other hand, when the average tear strength of the interlaced portions is less than 3 gf, the yarn is scarcely interlaced, and thus, the condensation of the yarn is reduced, thereby significantly reducing workability of an after-treatment process, such as a weaving process.

As well, it is preferable that the number of peaks, at which the average tear strength of the interlaced portions is 3 gf or more, is 8 peaks or less/5000 mm. When the number of the peaks is more than 8, the yarn is strongly interlaced rather than low and weakly-interlaced, leading to the poor surface appearance and quality of the coated fabrics.

Figure 7A:
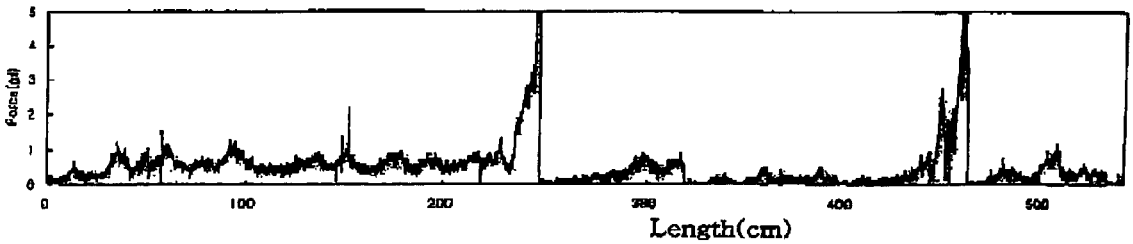
FIGS. 7A and 7B illustrate tear strengths of the low and weakly-interlaced polyester multifilament yarns according to the present invention, which are measured after the low and weakly-interlaced polyester multifilament yarn is cut at the center thereof.
Figure 7B:
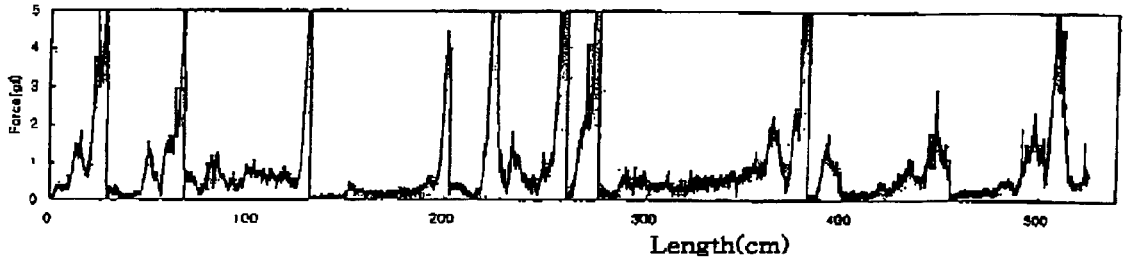
FIG.7B Prior Art

According to the present invention, in case that the low and weakly-interlaced yarn has 1000 deniers (refer to FIG. 7A), the average tear strength of the interlaced portions is 10 gf or less, and the number of the peaks (3 gf or more) of the yarn caused by the interlaced portions is 2 or less in every 5000 mm, which means that the yarn is low and weakly-interlaced and the number of the interlaced portions is reduced in comparison with a conventional interlaced yarn (FIG. 7B).

Figure 3:
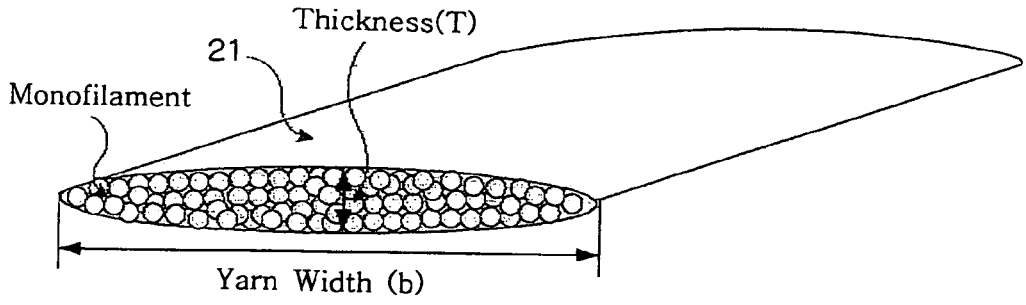
FIG. 3 illustrates a sectional view of the low and weakly-interlaced polyester multifilament yarn according to the present invention.
Figure 4:
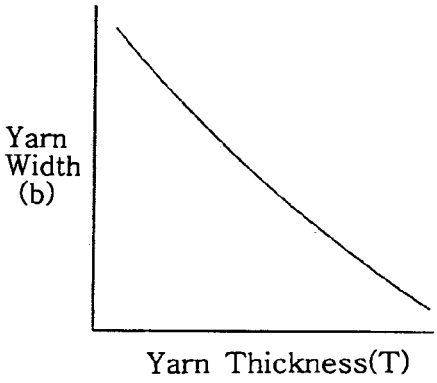
FIG. 4 is a graph showing a yarn width as a function of a yarn thickness for the low and weakly-interlaced polyester multifilament yarn according to the present invention.

As shown in FIGS. 3 and 4, the average thickness (T) of the low and weakly-interlaced yarn is an average of thicknesses of the entire yarn containing the interlaced portions. At this time, when the average thickness of the yarn is increased, a yarn width (b) of the yarn is reduced, leading to the poor flatness of the yarn. In other words, the one yarn 21 includes a plurality of monofilaments, and the yarn width (b) of the yarn depends on the arrangement of the monofilaments constituting the yarn 21. If different yarns each have the same number of monofilament layers, the average thickness (T) of each yarn is in inverse proportion to the yarn width (b) of each yarn.

Figure 5:
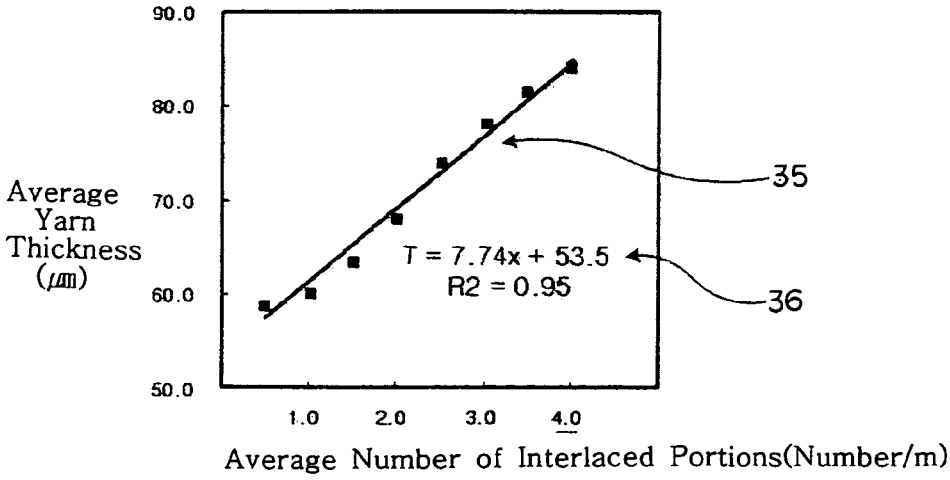
FIG. 5 is a graph showing an average yarn thickness (μm) as a function of an average number of the interlaced portions (number/m) for the low and weakly-interlaced polyester multifilament yarn according to the present invention.

Referring to FIG. 5, there is illustrated a graph 35 showing the average thickness as a function of the average number of the interlaced portions (X) for the low and weakly-interlaced polyester multifilament yarn according to the present invention. The correlation of the above two variables, that is, the average thickness and average number of the interlaced portions, is obtained according to a linear regression method, and a correlative equation 36 of the above two variables may be expressed as $T=10.9X+40.6$. At this time, a correlative constant R2 is 0.95. From data regarding the thicknesses of the interlaced yarn, it can be obtained that a slope is −2.29 to 15.71 and an Y-intercept is 32.1 to 66.1.

Figure 6:
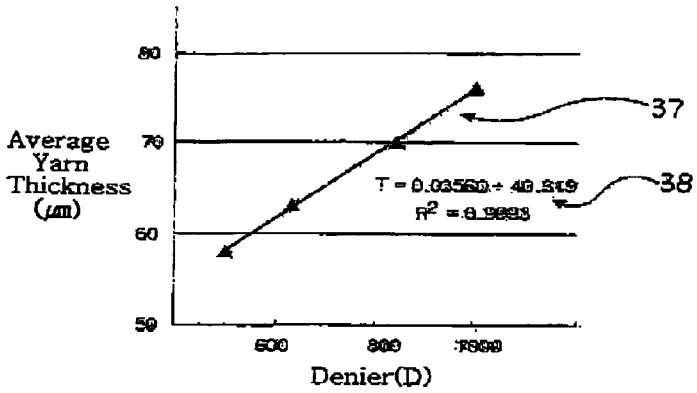
FIG. 6 is a graph showing the average yarn thickness (μm) of the low and weakly-interlaced polyester multifilament yarn according to the present invention, as a function of a fineness (denier) of a conventional industrial fiber.

With respect to the correlation of the fineness (D) and the average thickness (T) of the yarn, from FIG. 6, the correlative equation 37 of the fineness and the average thickness of the yarn is obtained, and may be expressed as $T = c3D + c4$. In this respect, the correlative constant R2 is 0.999. Additionally, it is most preferable that the correlative equation 37 is expressed as $T=0.036D+40.32$ (38)(where, c3 is a constant, c4 is a thickness constant, $0.018 \leqq c3 \leqq 0.052$, and $29 \leqq c4 \leqq 53$).

Figure 8:
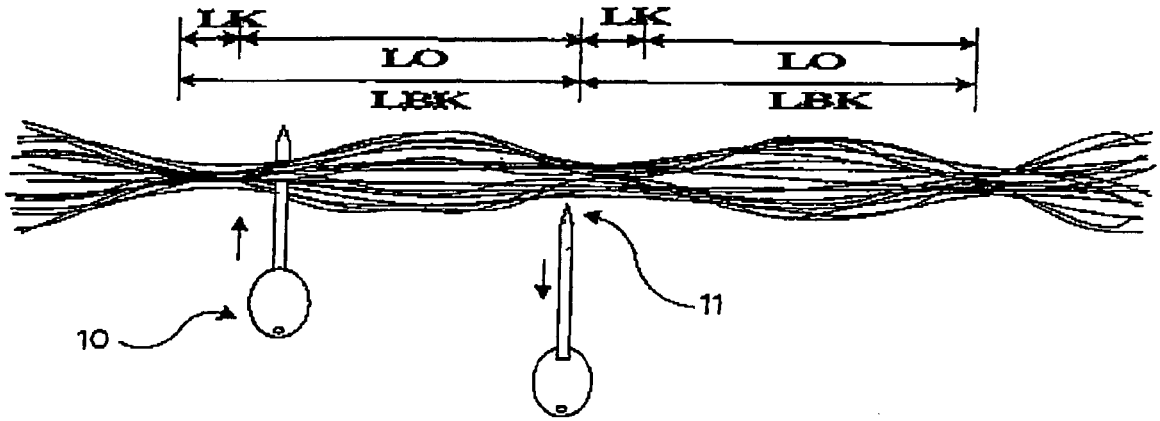
FIG. 8 Prior Art
FIG. 8 illustrates a strongly interlaced polyester multifilament yarn produced according to a conventional method, and an operation mechanism of a Rothschild.

A conventional interlaced yarn as shown in FIG. 8 is produced using relatively high air pressure and has many interlaced portions. In this regard, thickness deviations of the lengths of the interlaced portions (LK) and the lengths of the openings (LO) are relatively large.

Figure 1:
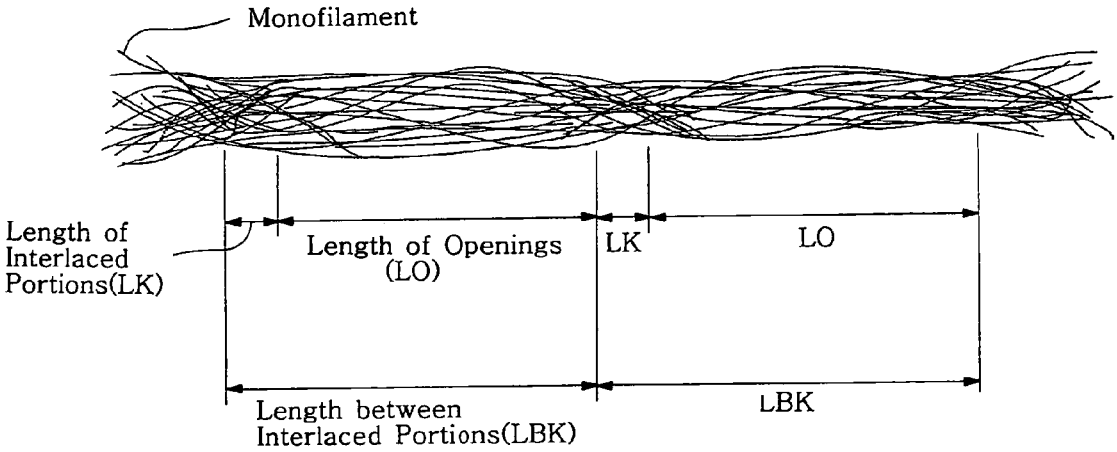
FIG. 1 illustrates a low and weakly-interlaced polyester multifilament yarn according to the present invention.
Figure 2:
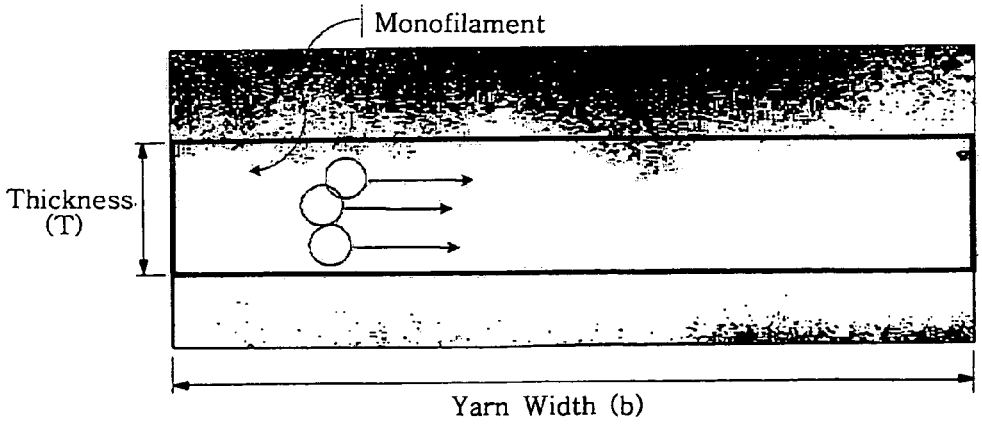
FIG. 2 illustrates an image of a section of the low and weakly-interlaced polyester multifilament yarn according to the present invention.

Meanwhile, FIG. 2 illustrates an enlarged image of a section of the low and weakly-interlaced polyester multifilament yarn according to the present invention. In this respect, the low and weakly-interlaced yarn of the present invention has the fineness of 840 deniers, and a few layers of monofilaments, that is, 3 to 4 monofilaments. Accordingly, the low and weakly-interlaced yarn of the present invention has excellent flatness.

Hereinafter, there will be described the low and weakly-interlaced polyester multifilament yarn and the method of producing the same, referring to FIGS. 2 to 12.

Figure 9A:
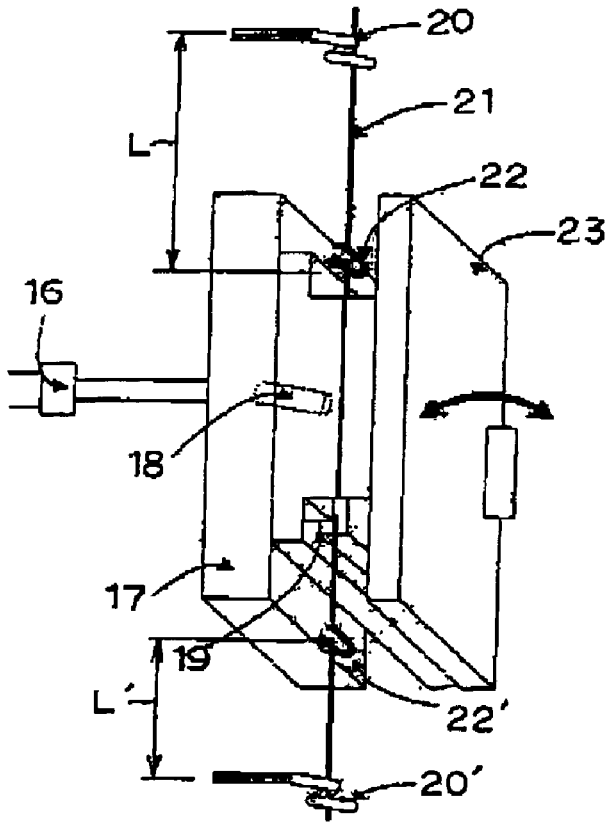
FIGS. 9A and 9B schematically illustrate an air interlacing device used in the present invention.

With reference to FIG. 9, there is schematically illustrated an air interlacing device 17 used in the present invention. If a pass nozzle 19 acting as a yarn path is sealed by a cover 23, the air interlacing device 17 is used as the seal-type interlacing device. On the other hand, the cover 23 is opened to expose the pass nozzle 19, the air interlacing device 17 is used as the open-type interlacing device. Additionally, when an air nozzle 18 is at a predetermined angle to a feeding direction of the yarn, the mono filaments constituting the yarn may be interlaced while an impact applied to the yarn is reduced.

Figure 10:
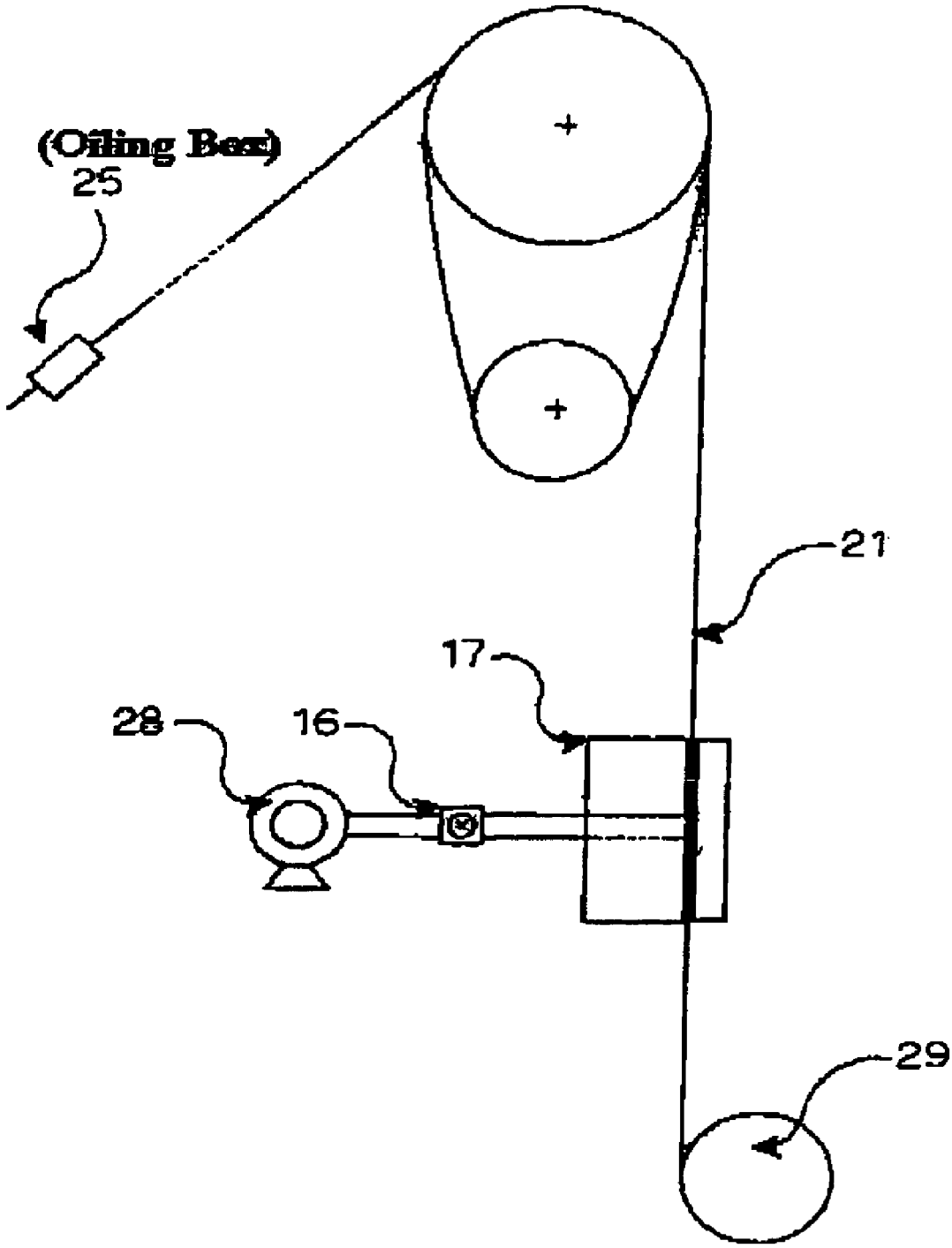
FIG. 10 schematically illustrates the production of the low and weakly-interlaced polyester multifilament yarn according to the present invention.

FIG. 10 schematically illustrates the production of the low and weakly-interlaced polyester multifilament yarn according to the present invention. In this respect, the yarn is subjected to an oiling process of 0.5 to 2.0 wt % lubricant oil so as to increase the condensation of the yarn in an oiling box 25, air pressure created by an air generator 28 is controlled to 1.00 to 1.40 kgf/cm$^2$ using an air controller 16, and the yarn is fed into the air interlacing device while its tension is controlled to 0.06 to 0.18 g/d. At this time, an incidence angle, that is, a winding angle ($\alpha$) of the yarn around a winding cake 29 is controlled to 5.8 to 8.5 degrees to increase the flatness of the yarn. When the air pressure is less than 1.0 kgf/cm$^2$ or the tension of the yarn is more than 0.18 g/d, it is difficult to interlace the yarn. On the other hand, when the air pressure is more than 1.40 kgf/cm$^2$ or the tension of the yarn is less than 0.06 g/d, it is difficult to produce the low and weakly-interlaced yarn and the workability is reduced.

According to the present invention, the yarn is low and weakly-interlaced to reduce the brightness gradient on the surface of the coated fabrics as end products, unlike a conventional invention (Korean Pat. Laid-Open Publication No. 2002-48368). As shown in FIG. 9, intervals (L, L') between first guides 20, 20', located before and after the air interlacing device 17, and second guides 22, 22', located in the air interlacing device 17, are reduced so as to weakly interlace the yarn. The intervals (L, L') are reduced to 50 cm or less so as to shorten wave length of the yarn vibration leading to the reduction of interlaced portions of the yarn, thereby enabling the yarn to be low and weakly-interlaced. Further, the intervals (L, L') between the first and second guides correspond to the portions of the yarn vibrated by the air pressure, and an air current collides with the monofilaments constituting the yarn to form turbulence to irregularly move the monofilaments. When the monofilaments irregularly move, a plurality of monofilaments come into contact with each other at the same position, at which the yarn is interlaced. Longer intervals (L, L') between the first and second guides brings about more active movement of the monofilaments to enable the monofilaments to more frequently come into contact with each other, leading to the strongly interlaced yarn rather than the low and weakly-interlaced yarn.

Figure 9B:
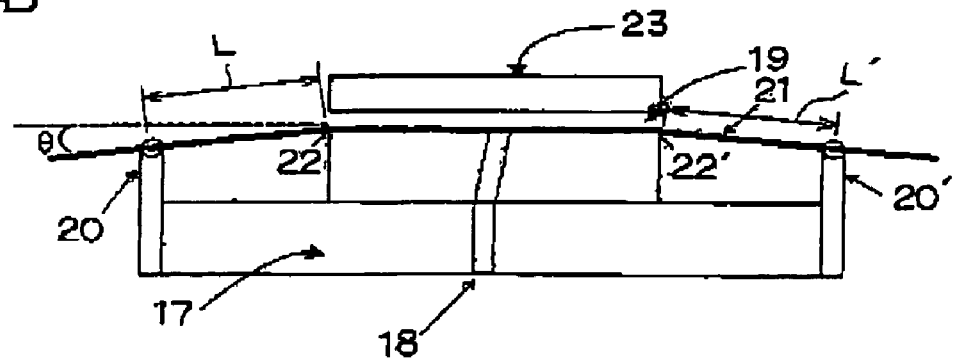

In addition, angles ($\theta$) between the second guides 22, 22', located in the air interlacing device, and the first guides 20, 20', located before and after the air interlacing device, are controlled to −5 to +5 degrees (refer to FIG. 9B). When the angles ($\theta$) deviate from a range of −5 to +5 degrees, the deviation of the interlaced portions is a poor 75% or more and the yarn does not have the uniform thickness, and thus, it is impossible to produce the low and weakly-interlaced yarn with excellent flatness.

According to the present invention, the fineness of each monofilament constituting the yarn is controlled to 3 to 8 deniers and the number of monofilament layers in the yarn is controlled to 3 to 4 so as to reduce thickness differences between the interlaced portions and the openings and to improve the flatness and flat uniformity of the yarn.

When the fineness of each monofilament is less than 3, the friction between the monofilaments is increased to conglomerate the yarn to reduce the flat uniformity of the yarn. On the other hand, when the fineness of each monofilament is more than 8, the number of monofilament layers may be increased from 3 or 4 by 1 or 2 layers due to an unstable spinning process, thereby increasing the thickness deviations of the yarn to reduce the flat uniformity of the yarn.

Figure 12:
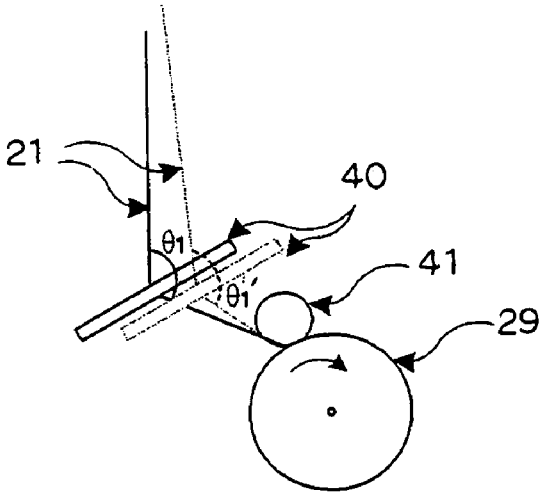
FIG. 12 schematically illustrates a helix angle of the yarn wound around a cheese in accordance with a position of a wave plate.

The wave plate 40, functioning to guide the yarn right before a winder 41, is positioned outside the winder 41 so as to control the number of the monofilament layers. Accordingly, the yarn is supplied to a winding cake with an angle ($\theta_1$) of 160° or less as shown in FIG. 12. In this regard, the angle ($\theta_1$) is less than a conventional angle ($\theta_1$') according to a conventional manner, leads to the increase of the tension of the yarn. Thereby, the yarn has the relatively large tension at the wave plate 40 to enable the monofilaments constituting the yarn to be smoothly flattened, contributing to improving a brightness of a coated fabrics, produced using the low and weakly-interlaced polyester multifilament yarn, for advertisement and to reducing a surface brightness gradient of the same.

Hereinafter, a detailed description will be given of the production of the low and weakly-interlaced yarn according to the present invention. Polyester chips with an intrinsic viscosity of 0.84 are wound at a winding speed of 3100 m/min to produce an industrial filament yarn according to a typical method. At this time, a speed of a godet roller may be identical to the winding speed, or the winding speed may be increased by 6 m/min to maintain a predetermined level of the tension between the godet roller and the winder. Additionally, the air pressure during the air interlacing of the yarn is controlled according to the fineness of the yarn, and an amount of a lubricant oil is constantly controlled.

Further, the oval air nozzle of the air interlacing device has a long diameter of 3.0 mm and a short diameter of 2.5 mm, and the speed of the yarn in the air interlacing device is 3100 m/min. Furthermore, the angle of the yarn path in the air interlacing device, that is to say, the angle ($\theta$) between the second guides 22, 22', located in the interlacing device, and the first guides 20, 20', located before and after the interlacing device, is set to 2° to the yarn. The winding angle ($\alpha$) is controlled according to a winding diameter in order to stabilize a shape of the cake and to increase the yarn path, so that the winding angle is set to 5.8, 6.8, and 6.3 degrees at initial, middle, and end winding steps, respectively. The thickness of the interlaced yarn subjected to a winding process is measured using a thickness gauge, and the interlaced portions is evaluated using a Rothschild R-2070.

Evaluation

1) The interlaced portions of the yarn is evaluated using the Rothschild according to an entanglement test R-2070. As shown in FIG. 8, a pin 11 connected to a power unit 10 is inserted into portions of the yarn, at which the interlaced portions are not formed, but does not advance toward interlaced portions of the yarn. At this time, the pin 11 horizontally moves by the length of one interlaced portions (LK) without advancing toward the yarn, and again inserted into the said portions of the yarn, at which the interlaced portions are not formed. In this regard, the length of one interlaced portion is set to 5 mm, and the interlaced portions are evaluated while the pin being moved. With respect to this, a moving length of the pin is measured and the number of the interlaced portions are counted to obtain data regarding the interlaced portions of the yarn. As measured variables, there are a measured speed and a trip level (TL), a measured number of the interlaced portions and a measured cycle. In this respect, the measured number of the interlaced portions and measured cycle may be set at one's convenience.

In the present invention, the measured speed is set to 20 m/min, the measured number of the interlaced portions are 30 per one cycle, and the measurement of the variables is conducted during three cycles. During the evaluation of the interlaced portions of the yarn, it is very important to properly control the trip level. When the trip level is very low, intermingled portions of the yarn may be mistakenly regarded as the interlaced portions of the yarn. On the other hand, when the trip level is very high, it is difficult to catch the interlaced portions of the yarn. The trip level of the yarn is determined by the following Equation 1.

$$\text{Trip level(cN)}=\text{yarn pretension}+\text{denier/the number of monofilaments} \qquad \text{Equation 1}$$

At this time, the yarn pretension is 0.1 cN/de. Hence, when the fineness is 840 deniers and the number of monofilaments is 192, the trip level is about 88.4 cN. As well, when the fineness is 1000 deniers and the number of monofilaments is 192, the trip level is 105.2 cN. However, in the Rothschild, an upper limit of the trip level is set to 100 cN. Accordingly, in the present invention, the yarn pretension is multiplied by a weight factor of 0.8, and thus, the trip level is 78 cN and 85 cN in the case of the fineness of 840 deniers and 1000 deniers, respectively.

A standard deviation of the lengths of the openings is divided by an average of the lengths of the openings, and then divided into a hundred parts to obtain the deviation of the interlaced portions (CV %). At this time, the said deviation is 75% or less in the present invention.

FIG. 5 is a graph showing the average yarn thickness (μm) as a function of the average number of the interlaced portions (number/m) for the low and weakly-interlaced polyester multifilament yarn according to the present invention.

2) The average thickness of the yarn is measured using the thickness gauge (scale unit: 1 μm), and thicknesses of 20 to 30 portions of the yarn are measured. The average thickness of the yarn is obtained from 20 to 30 thickness data, and measured points of the yarn are spaced from each other at intervals of 2 to 3 m.

3) The tear strength of the yarn is measured using an Instron 5565. At this time, gauge lengths between jogs are 50 mm, and measured lengths of samples are 1000 mm. In this regard, a crosshead speed is 30 mm/min, a load cell is 1 kgf, and a jog face is made of a rubber-like material. The yarn is cut using scissors and a section of the cut yarn is longitudinally split at the center thereof to produce the samples, and the samples are situated at upper and lower portions of the jogs. The measurement is repeated 6 times, and data regarding the interlaced portions as text files are expressed as a profile in an excel program (FIG. 7).

4) Helix Angle (α)

Figure 11A:
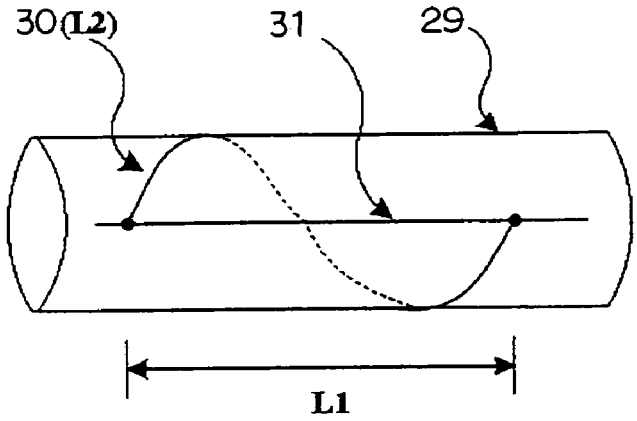
FIGS. 11A and 11B schematically illustrate a winding angle of the yarn wound around a cheese.
Figure 11B:
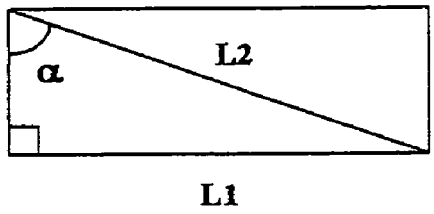

FIG. 11A illustrates the incidence angle, that is to say, the helix angle (α) of the yarn in the winding cake 29. The helix angle (α) significantly affects the spread of the yarn and a shape of the cake, and is set to 5.8 to 8.5° according to the winding diameter in consideration of the dimensional stability of the cake and the spread of the yarn. When the helix angle (α) of the yarn is less than 5.8° or more than 8.5°, the dimensional stability of the cake is reduced, the spread of the yarn is poor, and the thicknesses of the yarn become non-uniform. Additionally, the helix angle (α) of the yarn means a correlation between a first length (L1) and a second length (L2). In this regard, the first length (L1) is a length between two points of a virtual line 31, parallel to an axis of a paper tube, at which the one yarn 30 crosses the virtual line 31, and the second length (L2) is an actual length of the yarn 30 between the above two points of the virtual line 31, as shown in FIG. 11B. Therefore, the helix angle (α) is expressed by the following Equation 2, and is calculated by substituting the measured first and second lengths (L1 and L2) into the following Equation 2.

$$\overline{\text{Helix}}\ \text{angle}(\alpha) = \text{Sin}^{-1}\left(\frac{L1}{L2}\right) \qquad \text{Equation 2}$$

5) Appearance of the Coated Fabrics

The yarn is knitted, and then coated with polyvinyl chloride (PVC) in a thickness of 4 mm or less to produce samples with a size of 10 cm×10 cm. The samples are observed by a naked eye while being irradiated by light emitted from a fluorescent lamp and the like, and there is determined whether the yarn portion of the coated fabrics create bright and dark sides on a surface of the coated fabrics, or not. The coated fabrics having the bright and dark sides on the surface thereof is evaluated as the poor coated fabrics, and the coated fabrics having no bright and dark sides on the surface thereof is evaluated as the excellent coated fabrics.

Having generally described this invention, a further understanding can be obtained by reference to examples and comparative examples which are provided herein for the purposes of illustration only and are not intended to be limiting unless otherwise specified.

EXAMPLE 1

Polyester chips were spun to produce a filament yarn, having a fineness of 840 deniers and 192 filaments according to the above procedure. At this time, air pressure was 1.25 kgf/cm$^2$, and tension was 0.09 g/d. Further, the yarn was wound while intervals (L,L') as shown in FIG. 9 were each 35 cm and an angle of a wave plate was controlled to 145° to produce a low and weakly-interlaced yarn. The low and weakly-interlaced yarn had an average thickness of 70 μm, good flatness, an average number of the interlaced portions of 1.2 number/m, a good deviation of the interlaced portions (CV %) of 56%, tear strength of 5 gf at the interlaced portions thereof, and 3 peaks, having the tear strength of 3 gf or more, per 5000 mm. In this regard, the said deviation was measured using a Rothschild. The low and weakly-interlaced yarn was knitted in a relatively low density to produce a coated fabrics, an appearance of the coated fabrics was evaluated, and the results are described in the following Table 1.

EXAMPLE 2

The procedure of example 1 was repeated to produce a filament yarn. At this time, the yarn was wound while intervals (L,L') as shown in FIG. 9 were each 50 cm and an angle of a wave plate was controlled to 145° to produce a low and weakly-interlaced yarn. The low and weakly-interlaced yarn had an average thickness of 73 μm, good flatness, an average number of the interlaced portions of 1.8 number/m, a good deviation of the interlaced portions (CV %) of 67%, tear strength of 7 gf at the interlaced portions thereof, and 5 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

EXAMPLE 3

The procedure of example 1 was repeated to produce a filament yarn. At this time, the yarn was wound while an angle of a wave plate being controlled to 160° to produce a low and weakly-interlaced yarn. The low and weakly-interlaced yarn had an average thickness of 72 μm, good flatness, an average number of the interlaced portions of 2.0 number/m, a good deviation of the interlaced portions (CV %) of 61%, tear strength of 11 gf, and 4 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

EXAMPLE 4

The procedure of example 1 was repeated to produce a filament yarn. At this time, the yarn was wound while intervals (L,L') as shown in FIG. 9 were each 50 cm and an angle of a wave plate was controlled to 160° to produce a low and weakly-interlaced yarn. The low and weakly-interlaced yarn had an average thickness of 74 μm, good flatness, an average number of the interlaced portions of 2.3 number/m, a good deviation (CV %) of 70%, tear strength of 14 gf, and 7 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

COMPARATIVE EXAMPLE 1

The procedure of example 1 was repeated to produce a filament yarn. At this time, the yarn was wound while an angle of a wave plate being controlled to 165° to produce a low and weakly-interlaced yarn. The low and weakly-interlaced yarn had an average thickness of 74 μm, an average number of the interlaced portions of 2.8 number/m, a good deviation (CV %) of 69%, tear strength of 18 gf, and 9 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

COMPARATIVE EXAMPLE 2

The procedure of example 1 was repeated to produce a filament yarn. At this time, the yarn was wound while intervals (L,L') as shown in FIG. 9 being each 55 cm to produce a low and weakly-interlaced yarn. The low and weakly-interlaced yarn had an average thickness of 75 μm, an average number of the interlaced portions 3.5 number/m, a good deviation (CV %) of 72%, tear strength of 23 gf, and 9 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

COMPARATIVE EXAMPLE 3

The procedure of example 2 was repeated to produce a filament yarn. At this time, the yarn was wound while an angle of a wave plate being controlled to 165° to produce a low and weakly-interlaced yarn. The low and weakly-interlaced yarn had an average thickness of 76 μm, an average number of the interlaced portions of 3.2 number/m, a good deviation (CV %) of 70%, tear strength of 16 gf, and 14 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

COMPARATIVE EXAMPLE 4

The procedure of example 3 was repeated to produce a filament yarn. At this time, the yarn was wound while intervals (L,L') as shown in FIG. 9 being each 55 cm to produce a low and weakly-interlaced yarn. The low and weakly-interlaced yarn had an average thickness of 74 μm, an average number of the interlaced portions of 2.9 number/m, a good deviation (CV %) of 67%, tear strength of 18 gf, and 12 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

COMPARATIVE EXAMPLE 5

The procedure of example 4 was repeated to produce a filament yarn. At this time, the yarn was wound while intervals (L,L') as shown in FIG. 9 were each 55 cm and an angle of a wave plate was controlled to 165° to produce a low and weakly-interlaced yarn. The low and weakly-interlaced yarn had an average thickness of 76 μm, an average number of the interlaced portions of 3.8 number/m, a good deviation (CV %) of 73%, tear strength of 26 gf, and 19 peaks, having the tear strength of 3 gf or more, per 5000 mm. The low and weakly-interlaced yarn was knitted in a relatively low density to produce a coated fabrics, an appearance of the coated fabrics was evaluated, and the results are described in the following Table 1.

Conditions and results of examples 1 to 4 and comparative examples 1 to 5 are described in the following Table 1.

TABLE 1

| | [1]D. | [2]G. | [3]W. | [4]T. | [5]E. | [6]Th. | [7]I. | [8]De. | [9]S. | [10]P. | [11]Flat. | [12]B. |
|---|---|---|---|---|---|---|---|---|---|---|---|---|
| Ex. 1 | 840/192 | 35 | 145 | 7.9 | 22.6 | 70 | 1.2 | 56 | 5 | 3 | Excel. | Good |
| Ex. 2 | 840/192 | 50 | 145 | 7.9 | 22.9 | 73 | 1.8 | 67 | 7 | 5 | Excel. | Good |
| Ex. 3 | 840/192 | 40 | 160 | 7.8 | 23.0 | 72 | 2.0 | 61 | 11 | 5 | Excel. | Good |
| Ex. 4 | 840/192 | 50 | 160 | 7.8 | 23.4 | 74 | 2.3 | 70 | 14 | 7 | Excel. | Good |

TABLE 1-continued

| | [1]D. | [2]G. | [3]W. | [4]T. | [5]E. | [6]Th. | [7]I. | [8]De. | [9]S. | [10]P. | [11]Flat. | [12]B. |
|---|---|---|---|---|---|---|---|---|---|---|---|---|
| Co. Ex. 1 | 840/192 | 35 | 165 | 7.8 | 22.8 | 74 | 2.8 | 69 | 18 | 9 | Excel. | Poor |
| Co. Ex. 2 | 840/192 | 55 | 145 | 7.9 | 22.7 | 75 | 3.5 | 72 | 23 | 9 | Excel. | Poor |
| Co. Ex. 3 | 840/192 | 50 | 165 | 7.9 | 21.6 | 76 | 3.2 | 70 | 16 | 14 | Excel. | Poor |
| Co. Ex. 4 | 840/192 | 55 | 160 | 7.9 | 22.8 | 74 | 2.9 | 67 | 18 | 12 | Excel. | Poor |
| Co. Ex. 5 | 840/192 | 55 | 165 | 7.7 | 24.0 | 76 | 3.8 | 73 | 26 | 19 | Excel. | Poor |

[1]D.: denier/the number of monofilaments,
[2]G.: interval between the first and second guides (L or L', cm),
[3]W.: angle of wave plate (°),
[4]T.: tenacity (g/d),
[5]E.: elongation (%),
[6]Th.: thickness of the yarn (μm),
[7]I.: average number of the interlaced portions (number/m),
[8]De.: deviation of the interlaced portions(CV %),
[9]S.: tear strength (gf),
[10]P.: the number of peaks having tear strength of 3 gf or more,
[11]Flat.: flatness and flat uniformity,
[12]B.: brightness uniformity of the coated fabrics,
Excel.: excellent As apparent from the above description, a low and weakly-interlaced yarn according to the present invention has excellent flatness and flat uniformity. Accordingly, when the low and weakly-interlaced yarn is applied to a coated fabrics as end products, a brightness gradient on a surface of the coated fabrics is reduced when light is irradiated to the coated fabrics. Further, as the number of monofilament layers, each having a fineness of 3.0 to 8.0 deniers, is controlled, the flatness of the yarn is maximized, and a thickness of the yarn is reduced by about 5%.

In addition, the low and weakly-interlaced polyester multifilament yarn according to the present invention has advantages in that it contributes to improving quality of a coated fabrics, made of woven fabrics or knitted goods, because it is low and weakly-interlaced while having the excellent flatness and flat uniformity.

As well, the low and weakly-interlaced polyester multifilament yarn according to the present invention may be applied to other industrial fibers, such as Nylon 6, Nylon 66, PEN, and PTT.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A low and weakly-interlaced industrial polyester multifilament yarn with relatively high strength, wherein an average number of interlaced portions is 0.4 to 4.0 number/m, a deviation of the interlaced portions is 75 or less, an average thickness is 45 to 81 μm, an average tear strength of the interlaced portions is 3 to 15 gf, and a number of peaks, at which the average tear strength of the interlaced portions is 3 gf or more, is 8 peaks or less/5000 mm, wherein lengths of openings of the yarn are 5000 mm or less, wherein a winding angle of a yarn supplied to a winding cake ($\theta_1$) is 160° or less leading to an increase of a tension of the yarn, and an interval length in an interlacing device is 50 cm or less so as to shorten wave length of yarn vibrations leading to a reduction of interlace portions of the yarn whereby enabling the yarn to be low and weakly interlaced.

2. The low and weakly-interlaced industrial polyester multifilament yarn as set forth in claim 1, wherein a correlation of a fineness (D) and the average thickness (T) of the yarn is expressed as following equation:

$$T(\mu m)=c3D+c4$$

wherein, $0.18 \leqq c3 \leqq 0.052$ (c3 is a constant) and $29 \leqq c4 \leqq 53$ (c4 is a thickness constant), the most preferable average thickness being obtained from another equation, express as $$T=0.36D+40.32,$$

wherein a winding angle of a yarn supplied to a winding cake ($\theta_1$)is 160° or less leading to an increase of a tension of the yarn, and an interval length in an interlacing device is 50 cm or less so as to shorten wave length of yarn vibrations leading to a reduction of interlace portions of the yarn whereby enabling the yarn to be low and weakly interlaced.

3. A woven fabrics or knitted goods producing using the low and weakly-interfaced industrial polyester multifilament yarn according to claim 1.

4. The woven fabrics or knitted goods as set forth in claim 3, wherein the woven fabrics or knitted goods are coated with polyvinyl resins at a surface thereof.

5. A method of producing a low and weakly-interlaced polyester multifilament yarn with relative high strength, in which polyester multifilament is interlaced using an air interlacing device such that a tension is 0.06 to 0.18 g/d, air pressure is 1.00 to 1.40 kgf/cm$^2$, an average number of interlaced portions is 0.4 to 4.0 number/m, comprising;

controlling intervals between first guides and second guides to 50 cm or less, the first guides being located before and after the air interlacing device, and the second guides being located in the air interlacing device, wherein a winding angle of a yarn supplied to a winding cake ($\theta_1$) is 160° or less leading to an increase of a tension of the yarn, and an interval length in an interlacing device is 50 cm or less so as to shorten wave length of yarn vibrations leading to a reduction of interlace portions of the yarn whereby enabling the yarn to be low and weakly interlaced.

* * * * *